US009551484B2

(12) United States Patent
Dingemans et al.

(10) Patent No.: US 9,551,484 B2
(45) Date of Patent: Jan. 24, 2017

(54) ELECTRIC LAMP WITH PIN SAFETY ARRANGEMENT

(71) Applicant: PHILIPS LIGHTING HOLDING B.V., Eindhoven (NL)

(72) Inventors: Antonius Petrus Marinus Dingemans, Tilburg (NL); Allart Van Den Berg, Duiven (NL); Pieter Joseph Clara Van Der Wel, Heerlen (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 203 days.

(21) Appl. No.: 14/344,152

(22) PCT Filed: Sep. 21, 2012

(86) PCT No.: PCT/IB2012/055012
§ 371 (c)(1),
(2) Date: Mar. 11, 2014

(87) PCT Pub. No.: WO2013/046101
PCT Pub. Date: Apr. 4, 2013

(65) Prior Publication Data

US 2014/0355261 A1 Dec. 4, 2014

Related U.S. Application Data

(60) Provisional application No. 61/541,140, filed on Sep. 30, 2011.

(51) Int. Cl.
*H01R 33/00* (2006.01)
*F21V 25/04* (2006.01)
(Continued)

(52) U.S. Cl.
CPC ..... *F21V 25/04* (2013.01); *F21K 9/27* (2016.08); *F21V 23/06* (2013.01); *F21Y 2101/00* (2013.01);
(Continued)

(58) Field of Classification Search
CPC ..... F21K 9/27; F21V 23/06; F21V 25/04; F21Y 2101/00; F21Y 2103/00; F21Y 2103/10; F21Y 2115/10
(Continued)

(56) References Cited

U.S. PATENT DOCUMENTS 4,230,386 A * 10/1980 Farnworth ..... H01R 13/7036 439/188
5,422,487 A * 6/1995 Sauska ..... C02F 1/325 250/436
(Continued)

FOREIGN PATENT DOCUMENTS

CN 2917173 Y 6/2007
CN 201535456 U 7/2010
(Continued)

*Primary Examiner* — Peggy Neils
*Assistant Examiner* — Tsion Tumebo

(57) ABSTRACT

An electric lamp comprises a lighting module, a pin comprising an electric contact for powering the lighting module, and an insulating sleeve surrounding the pin and movable along the pin between a covering position and an uncovering position. Further, the sleeve covers the electric contact of the pin when in the covering position, and is retractable against the action of a biasing means to the uncovering position, in which the sleeve uncovers at least a portion of said electric contact of the pin.

16 Claims, 3 Drawing Sheets

(51) Int. Cl.
*F21V 23/06* (2006.01)
*F21Y 103/00* (2016.01)
*F21Y 101/00* (2016.01)

(52) U.S. Cl.
CPC ..... *F21Y 2103/00* (2013.01); *F21Y 2103/10* (2016.08); *F21Y 2115/10* (2016.08)

(58) Field of Classification Search
USPC ..... 362/249.05, 217.17; 29/592.1
See application file for complete search history.

(56) References Cited

U.S. PATENT DOCUMENTS

| | | | | |
|---|---|---|---|---|
| 5,600,199 | A | 2/1997 | Martin, Sr. et al. | |
| 5,904,415 | A * | 5/1999 | Robertson | F21V 19/008 362/217.16 |
| 2010/0181178 | A1* | 7/2010 | Chang | F21K 9/175 200/341 |
| 2012/0300445 | A1* | 11/2012 | Chu | F21V 25/04 362/217.13 |
| 2014/0009925 | A1* | 1/2014 | Verhoeven | F21K 9/175 362/221 |

FOREIGN PATENT DOCUMENTS

| | | | |
|---|---|---|---|
| CN | 201739814 | U | 2/2011 |
| DE | 3910872 | C1 | 4/1989 |
| JP | 2011070985 | A | 4/2011 |
| WO | 2009067074 | A1 | 5/2009 |
| WO | 2010069983 | A1 | 6/2010 |
| WO | 2011138141 | A2 | 11/2011 |
| WO | 2012058556 | A2 | 5/2012 |

* cited by examiner

ELECTRIC LAMP WITH PIN SAFETY ARRANGEMENT

FIELD OF THE INVENTION

The present invention relates to pin safety arrangements in electric lamps, particularly in retrofit lamps.

BACKGROUND OF THE INVENTION

Conventional tube lamps (fluorescent lamps) of the type having a two-pin connector at each end of the tube are, in steady-state operation, powered by a DC or AC electric current flowing between the connectors. The connectors are electrically disconnected until an arc has established in the tube. For this purpose, a starting procedure including preheating of the electrodes may be carried out by dedicated starting circuitry, which can be made inherently safe by being enabled only when the lamp is properly inserted into the fixture, so that live electric parts are always protected from touch. The starting circuitry may be of the switch-start/preheat, rapid-start or other type, and is commonly integrated in the fixture.

It is desirable to power a tube lamp retrofit in the same manner as the tube lamp it replaces, that is, by a current flowing between its end connectors. Depending on the internal circuitry of the lamp, potentially hazardous conditions may arise when the lamp is partially inserted or partially removed from the lamp fitting. Among the attempts to solve this problem, WO2009/067074 proposes a light emitting diode (LED) tube lamp having a power switch which is arranged to close the lamp circuit when two ends of the lamp simultaneously are inserted into the respective contact sockets. The power switch has two pressing members, which are arranged on each side of the contact pins. If the tube lamp is inserted slantingly into the contact socket, the power switch is actuated only by one of the pressing members, whereby a safety arrangement of guiding pins, grooves and stop heads prevents the power switch from closing the circuit. However, such a safety arrangement is technically rather complex.

SUMMARY OF THE INVENTION

It is an object of the present invention to overcome, or at least alleviate, the above-stated problems, and to provide an electric lamp with an improved pin safety arrangement.

This and other objects of the invention are achieved by means of an electric lamp having the features set forth in the independent claim. Preferable embodiments of the invention are defined in the dependent claims.

An electric lamp comprises a lighting module, a pin comprising an electric contact for powering the lighting module, and an insulating sleeve surrounding the pin and movable along the pin between a covering position and an uncovering position. According to the invention, the sleeve covers the electric contact of the pin when in the covering position, and is retractable against the action of a biasing means into the uncovering position, in which the sleeve uncovers at least a portion of said electric contact of the pin.

The lighting module may comprise one or more electric light sources and, possibly, drive means (e.g., power converter and ballast) and/or control means for these. As used herein, the electric contact may constitute the entire pin or a limited (outer, inner or intermediate) portion of the pin surface, the rest of the pin being insulated or otherwise safe to touch. It may also consist of a plurality of surfaces. The covering position of the sleeve is preferably one where it extends maximally from a frame of the lamp (or lamp body). However, the invention is not limited to this configuration, and if the electric contact is a proximal portion of the pin, an uncovering sleeve movement may indeed proceed in the distal direction.

The present invention is based on the idea of providing an insulating safety sleeve for the pin, which sleeve may be in its uncovering position when a force, e.g. applied to the sleeve by a surface of a lamp fitting (or fixture), pushes the sleeve against the action of the biasing means, and is in its covering position when no such force is present, e.g. when the pin has been removed from the lamp fitting, whereby the action of the biasing means has pushed the sleeve into its covering position. Hence, the sleeve may automatically alternate between the covering and the uncovering position as the pin is removed and inserted in the lamp fitting.

The present invention achieves its object in that the sleeve covers the potentially live electric contact of the pin when the lamp is partly inserted in, or partly removed from, the lamp fitting, during which process the pin may be exposed to a person installing the lamp. Thus, the risk of hazardous conditions arising during lamp installation and removal is reduced. When the pin is inserted in the lamp fitting, and hence, is no longer exposed to the installer, the sleeve uncovers the electric contact, thereby enabling a drive voltage (e.g., mains) provided from the lamp fitting to connect to the pin and power the lighting module.

Furthermore, the present invention is advantageous in that it provides a pin safety arrangement with a reduced number of components and a reduced technical complexity. The movable structure of the pin safety arrangement in its simplest realization is basically limited to the sleeve and the biasing means. Thus, the present invention may provide an improved robustness in comparison with known pin safety arrangements, as well as reduced manufacturing costs.

According to an embodiment of the present invention, the sleeve may be mounted to a frame of the lamp via a spring forming said biasing means. The lamp frame forms the body of the lamp from which the pins extends and in which the lighting module is arranged. Hence, the sleeve is movable in relation to the lamp frame under influence of the action of the spring. Additionally, the biasing means may connect the sleeve to at least one intermediary element, which is in turn attached to a part of the lamp, such as the frame.

According to an embodiment of the present invention, the lamp may further comprise an activating member, which is adjustable between a transport position (or deactivating position), in which the activating member disconnects the pin and the lighting module electrically and preferably retains the sleeve in the uncovering position, and a use position (or activating position), in which the activating member allows the sleeve to move between said covering position and said uncovering position and preferably connects the pin and the lighting module electrically. Preferably, the sleeve is movable between the covering and uncovering positions against the action of the biasing means, so that the safer covering position is the default one.

The present embodiment operates as follows. When the activating member is set in the transport position and the pin is disconnected from the lighting module, the electric contact is disabled from becoming live. In the transport position, the sleeve may preferably be retained in the uncovering position since no cover is needed to protect the non-live electric contact. However, when the activating member is set in the use position, wherein the pin may be connected to the lighting module, possibly making the electric contact live (e.g. if one end of a tube lamp is inserted in a lamp fitting), the activating member activates the sleeve arrangement by allowing the biased movement of the sleeve between the covering and the uncovering position. Thus, in the present embodiment, the sleeve arrangement cooperates with an arrangement for electrically disconnecting the pin and the lighting module, thereby providing a lamp which is intrinsically safer to handle and install. For example, the activating member may fulfill a second purpose as an electric switch between the pin and the lighting module; alternatively, the activating member may cause disconnection of the pins indirectly by influencing a switching mechanism as it is moved between its use and transport position.

It will be appreciated that the transport position of the activating member may be used for other purposes than delivery of the lamp. Indeed, when the activating member is in transport position, the lamp is in a mode suitable for transport or other handling as the electric contact is disabled from becoming live regardless of the connection state of additional pins of the lamp. This mode may be used, e.g., when the lamp is transported, handled by an installer and even after installation. For instance, the activating member may be adjusted to the use position only after the lamp has been properly installed in the lamp fitting. Likewise, when the activating member is in the use position, the lamp is in a mode suitable for operation, as the lighting module is susceptible of being powered via the electric contact. This may be a suitable mode e.g. when the lamp is transported or handled by an installer, but most preferably when the lamp has been installed (and is mounted in) the lamp fitting. Further examples of when to adjust the activating member between its two positions will be described in the detailed disclosure. One advantage of this embodiment is reduced fatigue and/or wear on the biasing means. Another advantage is that it offers the option of actuating the activating member into its use position before the lamp is mounted in a fitting that covers the activating member or makes it difficult to access.

According to embodiments of the invention, the biasing means may be mounted to a frame of the lamp via the activating member, thereby interconnecting the sleeve arrangement and the activating member. Further, the activating member may be a rigid element movable along the frame of the lamp between the transport position and the use position. The activating member may be a lever e.g. slidably arranged in a slot of the frame or arranged as a rocker arm in the frame. Further, the transport position and the use position may be two distinct positions for the activating member, e.g. achieved by a notch in the slot. When the activating member is moved to the transport position, consequently, the endpoint of the biasing means that faces away from the sleeve is also moved (preferably in a direction facing away from the sleeve), thereby reducing (or even eliminating) the force which the biasing means exerts on the sleeve, so that the latter may return to its uncovering position. Hence, when the activating member is in the transport position, the sleeve arrangement is deactivated in the sense that the sleeve is not necessarily pushed to its covering position by the action of the biasing means. Further, when the activating member is moved to the use position, consequently, the same endpoint of the biasing means is also moved (preferably in a direction facing the sleeve), thereby increasing the force that the biasing means exerts on the sleeve. Hence, when the activating member is in the use position, the sleeve arrangement is activated in the sense that the relaxed position of the sleeve is its covering position, by the action of the biasing means. The present embodiment is advantageous in that it provides a safer lamp while the interaction between the sleeve arrangement and the activating member has a reduced technical complexity and an improved robustness.

According to embodiments of the present invention, the pin may be adapted to be inserted in a lamp fitting, a surface of which urges the sleeve into its uncovering position upon insertion of the pin in the lamp fitting, which is advantageous in that the sleeve is automatically urged into the uncovering position upon installation of the pin in the lamp fitting. This surface may for instance be the flat surface surrounding the connection apertures in an electric socket. Further, the sleeve may be released into its covering position, as ensured by the biasing means, upon removal of the pin from the lamp fitting. This applies both to such embodiments of the invention that do not include an activating member and such that do, provided this is set in its use position. This is advantageous from the point of view of safety in that the sleeve automatically covers the potentially live electric contacts and protects them from touch.

According to an embodiment of the present invention, the sleeve may be arranged to be at least partly contained inside a compartment (or housing) of the lamp when in the uncovering position, which is space-saving.

According to an embodiment of the present invention, the tip (or distal end) of the pin may be covered with an electrically insulating coating, which is advantageous in that it reduces the risk of an installer or object coming into contact with any portion of the pin being potentially live. In the language of the claims, the extent of the electric contact is reduced. For example, if the sleeve is pushed slightly towards its uncovering position by an object (or a human) depressing the sleeve tip, the tip of the pin may come into contact with that object. With the present embodiment, the sleeve and the coated tip together may cover (at least almost) the entire pin and protect an installer from coming into contact with the electric contact on the pin.

According to an embodiment of the present invention, the lamp is a light emitting diode (LED) tube lamp with an improved pin safety arrangement as outlined above. With the LED tube lamp according to the present embodiment, the risk of touching the electric contact when the LED tube lamp is partially inserted or partially removed from the lamp fitting is reduced. When one pin of a LED tube lamp with two pins is installed and the pin at the opposite end is potentially live and exposed to the installer, the sleeve is either biased into its covering position or, if the activating member is in its transport position, the pin is disconnected from the lighting module and hence from any electric voltage.

According to an embodiment of the present invention, the lamp may comprise a plurality of pins, each having a corresponding sleeve. Typically, tube lamps are provided with two pins at each end, and in the present embodiment, each pin of such a lamp may be coverable with a corresponding sleeve.

In an embodiment, at least two pins of said plurality of pins may be arranged parallel to one another and the sleeves associated with the at least two pins may be rigidly interconnected, which is advantageous in that merely one biasing means is required to exert a force on the sleeves.

In a further embodiment, the lamp may comprise at least two subgroups of pins, each comprising at least one pin of said plurality of pins, wherein sleeves within different subgroups are non-connected and preferably independently movable. For example, sleeves associated with one subgroup of pins may be located at one end of the tube lamp and sleeves associated with another subgroup of pins may be located at the opposite end of the tube lamp, wherein such two subgroups of sleeves may move independently of each other as the lamp is installed or removed.

It is noted that the invention relates to all possible combinations of features recited in the claims.

BRIEF DESCRIPTION OF THE DRAWINGS

This and other aspects of the present invention will now be described in more detail with reference to the appended drawings showing embodiments of the invention.

All figures are schematic, not necessarily to scale, and generally only show parts which are necessary in order to elucidate the invention, wherein other parts may be omitted or merely suggested.

DETAILED DESCRIPTION

Figure 1:
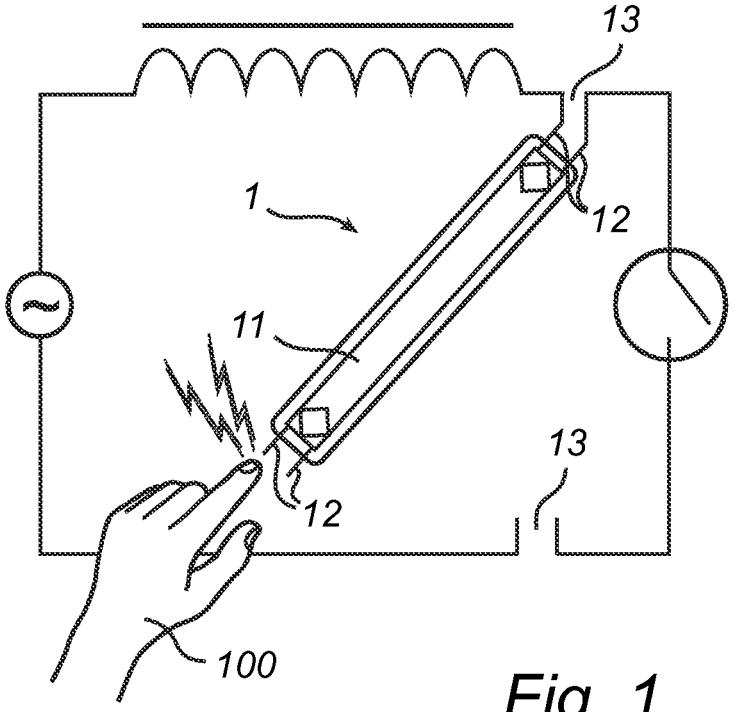
FIG. 1 illustrates a safety risk arising when an LED tube lamp without any pin safety arrangement is installed in a lamp fitting.

FIG. 1 shows an LED tube lamp 1 which is being installed in a lamp fitting 13 by an installer 100. The lamp 1 is provided with pins 12 adapted to fit in the lamp fitting 13 for powering a lighting module 11 of the lamp 1. However, the lamp 1 shown in FIG. 1 is not provided with any pin safety arrangement. As the installer 100 has fitted one of the tube ends of the lamp 1 in the lamp fitting 13, the power converter and ballast for driving the lighting module 11 establish a current path through the lighting module 11. As the lighting module 11 is electrically connected to the pins 12 at the end of the lamp 1 exposed to the installer 100, these pins 12 will become live and the installer may be subject to an electric shock if he or she touches the pins 12 at the exposed end.

With reference to FIGS. 2A-2D, a lamp according to embodiments of the present invention will be described.

Figure 2A:
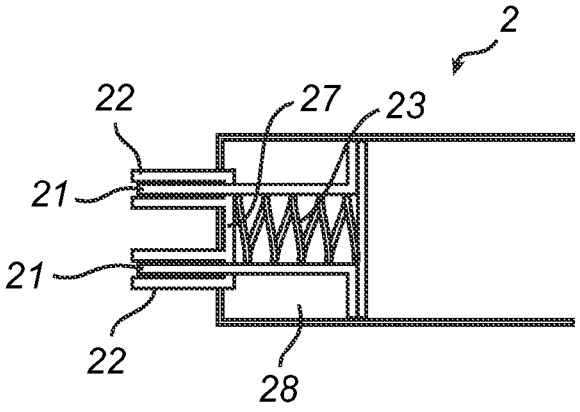
FIG. 2A is a schematic view of a lamp according to an embodiment of the present invention, with sleeves being in a covering position.
Figure 2B:
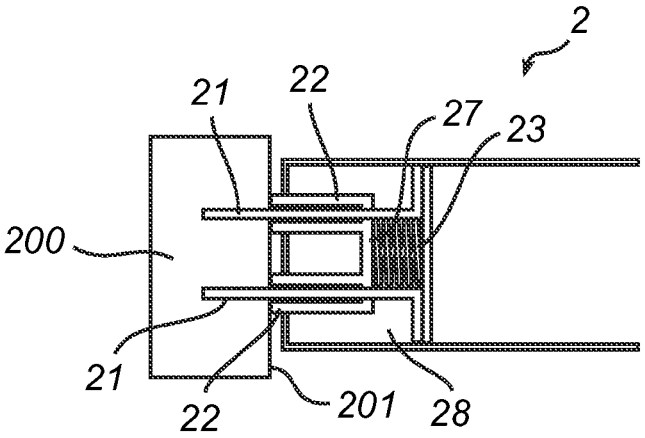
FIG. 2B shows the lamp of FIG. 2A, but when the sleeves are in an uncovering position.

FIGS. 2A and 2B is a schematic view of an end of a lamp 2 provided with a pin safety arrangement. The lamp 2 comprises two pins 21 arranged at the end of the lamp 2, each having an electric contact (not shown) through which a lighting module (not shown) of the lamp 2 may be powered. The electric contacts may occupy a portion, or all, of the pins 21. For example, the pin 21 may be made of metal, whereby the whole pin 21 may form the electric contact. The lamp 2 further comprises two sleeves 22, wherein each sleeve 22 is arranged to surround its corresponding pin 21 in the azimuthal direction and be movable along the pin 21 in the axial direction. For example, each sleeve 22 may be formed of a tube shaped element threaded onto the pin 21. The sleeves 22 are made of an electrically insulating material, such as plastic or a ceramic material. Advantageously, the material may be selected to resist excess heat conducted from the lighting module. Preferably, the sleeves 22 are rigidly interconnected, e.g. by a supporting element 27. The sleeves 22 are supported in a frame of the lamp 2, via the supporting element 27, by a spring 23 acting as a biasing means. For the sake of simplicity, the spring 23 is schematically depicted as a coil spring in FIGS. 2A and 2B, but the spring 23 may be formed of any suitable resilient element, and is preferably made of an electrically insulating material, such as plastic, so as not to act as a short circuit if the spring 23 should come into contact with the pins 21 or any other electrically conducting part.

FIG. 2A shows the lamp end when it is not inserted in a lamp fitting, wherein the sleeves 22 are urged by the action of the spring 23 into a covering position, in which they cover the distal portions of the pins 21. In this covering position, the electric contacts of the pins 21 are covered by the sleeves 22.

FIG. 2B shows the lamp end when it is inserted in a lamp fitting 200, wherein the sleeves 22 are urged by a surface 201 of the lamp fitting 200 against the action of the spring 23 into an uncovering position. In this uncovering position, at least those portions of the electric contacts that have been inserted in the lamp fitting 200 are uncovered by the sleeves 22, and the sleeves 22 are contained in a compartment 28 formed at the end of the frame of the lamp 2.

Figure 2C:
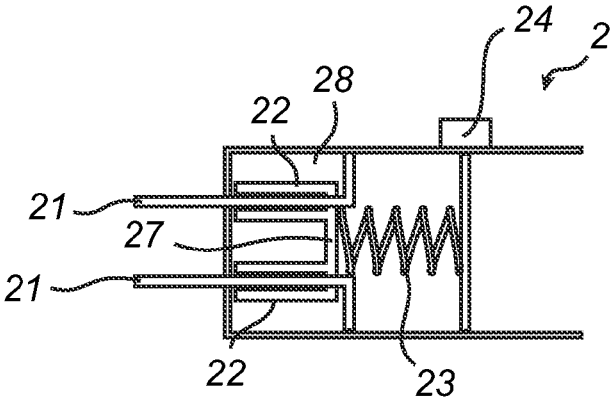
FIG. 2C is a schematic view of a lamp according to another embodiment of the present invention, with an actuating member being in a transport position.
Figure 2D:
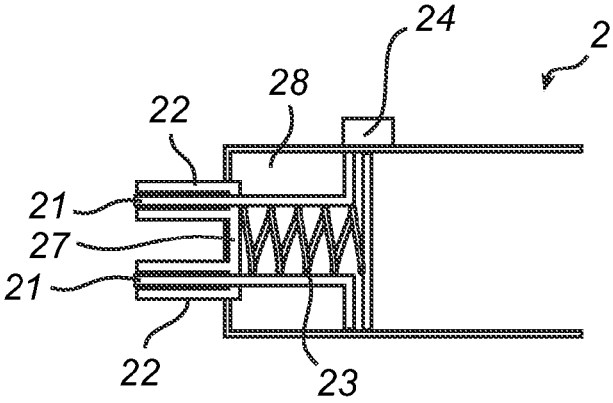
FIG. 2D shows the lamp of FIG. 2C, but when the actuating member is in a use position.

In an embodiment, the lamp 2 may further comprise an activating member 24, as schematically illustrated in FIGS. 2C and 2D. The activating member 24 may be set in a transport position, as shown in FIG. 2C, wherein the sleeve arrangement is deactivated. In its transport position, the activating member 24, which acts as a support for the spring 23, retains the sleeves 22 in their uncovering position while maintaining the spring 23 in a relaxed mode. Further, the activating member 24 may be set in a use position, as shown in FIG. 2D, wherein the activating member 24 activates the sleeve arrangement by moving the support for the spring 23 towards the end surface of the lamp frame, such that the sleeves 22 are in a covering position when the spring 23 is relaxed and can be urged into a covering position by the lamp fitting. Further details about the activating member and its positions will be described with reference to FIGS. 3A-3C.

Figure 3C:
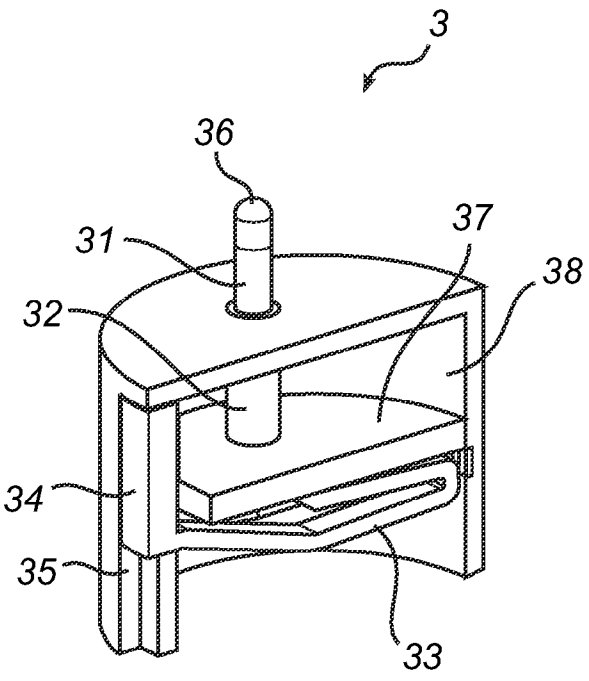
FIG. 3C shows the lamp of FIG. 3A, but when the actuating member is in a use position, and with sleeves being in an uncovering position.
Figure 3B:
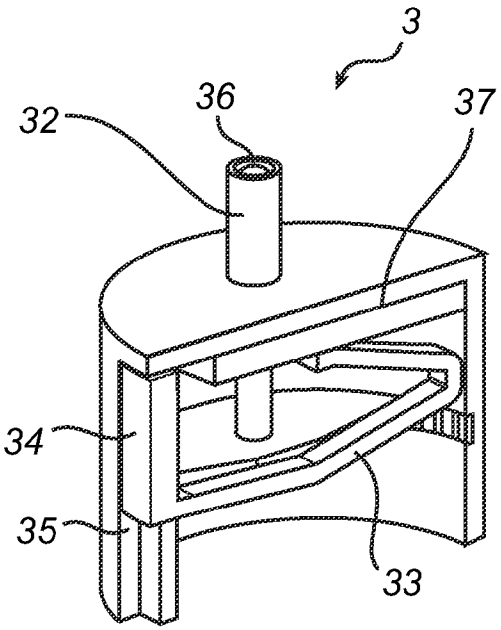
FIG. 3B shows the lamp of FIG. 3A, but when the actuating member is in a use position, and with sleeves being in a covering position.
Figure 3A:
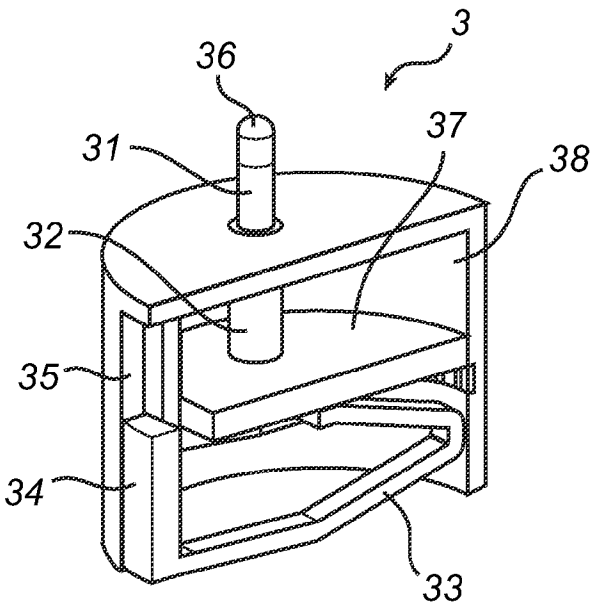
FIG. 3A is a cross-sectional view of lamp according to another embodiment of the present invention, with an actuating member being in a transport position.

With reference to FIGS. 3A-3C, a lamp according to another embodiment of the present invention will be described.

FIGS. 3A-3C are cross-sectional views of an end of a lamp 3 provided with a pin safety arrangement. The lamp 3 comprises a pin 31 made of metal (the lamp 3 may comprise two or more pins 31, but only one is shown in FIGS. 3A-3C), wherein the tip 36 of the pin 21 is covered with an electrically insulating coating, such as a plastic, rubber or ceramic coating. The coating may have been applied as an ink or in dry form. As the pin 31 is made of metal, an electric contact is formed by the portion of the pin not covered with insulating coating. The electric contact is adapted to conduct power to a lighting module (not shown) of the lamp 3.

The lamp 3 further comprises an insulating sleeve 32 surrounding the pin 31 and movable along (the axial direction of) the pin 31. Advantageously, the length of the sleeve 32 may match (or correspond to), or be slightly longer than, the length of the portion of the pin 31 extending from the end surface of the frame of the lamp 3, such that the sleeve 32 is able to cover the whole length of this portion of the pin 31 extending from the end surface of the frame of the lamp 3. The remaining portion of the pin 31, which is contained inside the frame of the lamp 3, need not be covered by the sleeve 32. Further, the sleeve 32 is arranged on a support element 37, preferably made of an electrically insulating material. Preferably, the sleeve 31 and the support element 37 may be formed (such as moulded) in a single piece.

The lamp 3 further comprises an activating member 34 movable in a slot 35 back and forth towards the end surface of the lamp 2, preferably in the axial direction of the lamp 2. The activating member 34 is interconnected with one end of the spring 33. The activating member 34 and the spring 33 may advantageously be formed in a single piece, preferably made of plastic, such as illustrated in FIGS. 3A-3C. The other end of the spring 33 is arranged to support the supporting element 37. Hence, the spring 33 interconnects the sleeve 31 and the activating member 34.

According to an embodiment, the sleeve may be directly connected to the spring and the spring in turn may be directly coupled to the activating member (not shown). Preferably, the sleeve, the spring and the activating member may be made (such as moulded) in a single piece.

Still with reference to FIGS. 3A-3C, the different positions of the activating member 34 and the sleeve 31 of the lamp 3 will now be described.

FIG. 3A shows the lamp 3 when the activating member 34 is in a transport position, wherein it has been slid away from the end surface of the lamp frame. In this transport position, the sleeve 32 has been retracted into a compartment 38 formed at the end of the lamp frame, by the spring 33 and is in an uncovering position. Consequently, the sleeve uncovers the pin 31 and its electric contact. In this position, the spring 33 is in a substantially relaxed (non-tensioned) mode.

In the transport position, the activating member 34 is further arranged to disconnect the pin 31 and the lighting module, thereby disabling a current path from the lighting module to the electric contact. This may e.g. be achieved by the activating member 34 controlling a switch (not shown) opening and closing the electric path between the pin 31 and the lighting module.

FIG. 3B shows the lamp 3 when the activating member 34 is in a use position, wherein it has been slid towards the end surface of the lamp frame, whereby the sleeve arrangement is activated. As the activating member 34 is moved closer to the end surface of the lamp frame, the spring 33 will exert a force on the supporting element 37 towards the end surface of the lamp frame. If no counter force is exerted on the sleeve 32 against the action of the spring 33, the supporting element 37 will be moved towards the end surface of the lamp frame and the sleeve 32 will be moved into its covering position, in which it covers the electric contacts of the pin 31. This covering position of the sleeve 32 is shown in FIG. 3B. Advantageously, the motion of the sleeve 32 is limited in the distal direction, whereby the sleeve 32 is pre-tensioned so that it cannot be pushed away from the pin 31 unless a threshold force is applied.

In the use position, the activating member 34 may be further arranged to connect the pin 31 and the lighting module (e.g. by the means of the switch), thereby enabling a current path from the lighting module to the electric contact.

FIG. 3C shows the lamp 3 when the activating member 34 is in the use position, but when a force is exerted on the sleeve 32, which force has urged the sleeve 32 to be slid into the compartment 38 against the action of the spring 33. As a result, the sleeve 32 is positioned in its uncovering position, in which is uncovers the electric contact of the pin 32, as shown in FIG. 3C. The force urging the sleeve 32 into its uncovering position may e.g. be exerted by a surface of a lamp fitting (not shown) as the lamp 3 is installed.

An example of how the lamp 3 according to the present embodiment can be used will now be described, still with reference to FIGS. 3A-3C.

During transport and handling of the lamp 3, the activating member 34 may preferably be set in the transport position (as shown in FIG. 3A), wherein the pin 32 is disconnected to the lighting module, since the lighting module need not be powered in this phase. Advantageously, the activating member 34 may still be in the transport position during installation of the lamp 3 in the lamp fitting. Setting the activating member in the transport position ensures that the pin 32 is unable to become live when the lamp 3 is partially installed in the lamp fitting, as the current path from the lighting module to the pin 31 is interrupted.

When the lamp 3 has been properly installed in the lamp fitting, the installer may actuate the activating member 34 into its use position, whereby the pin 31 is connected to the lighting module to enable powering of the lighting module. Since the lamp 3 is mounted in the lamp fitting, the sleeve 32 is urged into its uncovering position as shown in FIG. 3C.

If the activating member 34 is difficult, or even impossible, to access when the lamp 3 is in its installed position in the lamp fitting, it is advantageous to set the activating member 34 in the use position prior to the installation. The sleeve 32 will then be moved to its covering position, which is shown in FIG. 3B, thereby protecting the installer from the potentially live electric contact of the pin 31 when the lamp 3 is partially installed. As the end of the lamp 3 is inserted in the lamp fitting, the sleeve 32 will be urged back to its uncovering position shown in FIG. 3C.

Upon removal of the lamp 3 from the lamp fitting, the sleeve 32 will flip to its covering position if the activating member 34 is in the use position. Alternatively, the activating member 34 may be put in the transport position (by the installer) prior to the removal of the lamp 3.

It will be appreciated that the activating member 34 may be adjusted between the transport position and the use position on any occasion, as desired. For example, the activating member 34 may be in the use position also during transport and handling of the lamp 3.

The person skilled in the art realizes that the present invention by no means is limited to the preferred embodiments described above. On the contrary, many modifications and variations are possible within the scope of the appended claims. For example, features (such as shapes, materials and measures) of the lamp described with reference to FIGS. 2A and 2B may also be applied to the lamp described with reference to FIGS. 3A-3C, and vice versa.

The invention claimed is:

1. An electric lamp comprising:

a lighting module;

a pin comprising an electric contact for powering the lighting module; and an insulating sleeve surrounding the pin and movable along the pin between a covering position and an uncovering position, wherein the sleeve covers the electric contact of the pin when in the covering position, and is retractable against the action of a biasing means to the uncovering position, in which the sleeve uncovers at least a portion of said electric contact of the pin, said lamp further comprising an externally-accessible activating member coupled with at least one end of the biasing means whereby manipulation of the activating member moves the biasing means along a longitudinal axis of the electric lamp, the activating member adjustable between a transport position, in which the activating member disconnects the pin and the lighting module, and a use position, in which the activating member connects the pin and the lighting module and allows the sleeve to move between said covering position and said uncovering position subject to the action of the biasing means.

2. A lamp as defined in claim 1, wherein the sleeve is mounted to a frame of the lamp via a spring forming said biasing means.

3. A lamp as defined in claim 1, wherein the biasing means is mounted to a frame of the lamp via the activating member.

4. A lamp as defined in claim 3, wherein the activating member is a rigid element movable along the frame of the lamp between the transport position and the use position.

5. A lamp as defined in claim 1, wherein the pin is adapted to be inserted in a lamp fitting and the sleeve is located in such manner that it is urged into its uncovering position by a surface of the lamp fitting upon insertion of the pin in the lamp fitting.

6. A lamp as defined in claim 1, wherein the sleeve is pushed into its covering position upon removal of the pin from a lamp fitting if the activating member is in its use position.

7. A lamp as defined in claim 1, wherein the sleeve is arranged to be at least partly contained inside a compartment of the lamp when in the uncovering position.

8. A lamp as defined in claim 1, wherein the tip of the pin is covered with an electrically insulating coating.

9. A lamp as defined in claim 1, wherein the lamp is a tube lamp comprising a plurality of LEDs.

10. A lamp as defined in claim 1, comprising a plurality of pins, each having a corresponding sleeve.

11. A lamp as defined in claim 10, wherein at least two pins of said plurality of pins are arranged parallel to one another and the sleeves associated with the at least two pins are rigidly interconnected.

12. A lamp as defined in claim 10, comprising at least two subgroups of pins, each comprising at least one pin of said plurality of pins, wherein sleeves within different subgroups are non-connected and independently movable.

13. The lamp of claim 1, wherein the biasing means comprises a spring to bias the insulating sleeve toward the covering position, the spring including a first end that is interconnected with the insulating sleeve and a second end opposite the first end, and wherein the activating member is interconnected with the second end of the spring.

14. A tube lamp comprising:

a tubular housing;

a plurality of LEDs arranged along a longitudinal axis of the tubular housing;

at least two pins arranged parallel to each other, each comprising an electric contact to power the plurality of LEDs;

at least two insulating sleeves, each surrounding one of the at least two pins, wherein the at least two insulating sleeves are rigidly interconnected by a support element;

a spring interconnected to the support element at a first end; and an externally-manipulable activating member interconnected to a second end of the spring opposite the first end, the activating member manipulable between a transport position, in which the activating member disconnects the at least two pins from the plurality of LEDs, and a use position, in which the activating member connects the at least two pins to the plurality of LEDs;

wherein manipulation of the activating member from the transport position to the use position moves the spring along the longitudinal axis in a direction towards the support element and transitions the support element into a covering position, in which the at least two sleeves cover the electric contacts of the at least two pins, wherein while in the covering position, the support element is moveable against bias of the spring to an uncovering position, in which the at least two sleeves uncover at least a portion of said electric contacts of the at least two pins.

15. The tube lamp of claim 14, wherein the spring and the externally-manipulable activating member are moulded as a single piece.

16. The tube lamp of claim 14, wherein the spring, the support element, and the externally-manipulable activating member are moulded as a single piece.

* * * * *